US011676465B1

(12) United States Patent
Ruffa et al.

(10) Patent No.: US 11,676,465 B1
(45) Date of Patent: Jun. 13, 2023

(54) FIRE DETECTION AND CONFLAGRATION EVENT MONITORING AND DIAGNOSIS SYSTEM

(71) Applicant: The United States of America as represented by the Secretary of the Navy, Newport, RI (US)

(72) Inventors: Anthony A Ruffa, Hope Valley, RI (US); Charles M Traweek, Saint Leonard, MD (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 17/580,690

(22) Filed: Jan. 21, 2022

Related U.S. Application Data

(60) Provisional application No. 63/229,144, filed on Aug. 4, 2021.

(51) Int. Cl.
*G08B 17/06* (2006.01)
*G08B 17/107* (2006.01)
*A62C 37/40* (2006.01)

(52) U.S. Cl.
CPC ..... *G08B 17/06* (2013.01); *A62C 37/40* (2013.01); *G08B 17/107* (2013.01)

(58) Field of Classification Search
CPC ..... G08B 17/06; G08B 17/107; A62C 37/00; A62C 37/40
See application file for complete search history.

(56) References Cited

U.S. PATENT DOCUMENTS

| | | | | | |
|---|---|---|---|---|---|
| 4,855,718 | A * | 8/1989 | Cholin | G01J 1/04 | 431/13 |
| 4,994,791 | A * | 2/1991 | Taylor | G02B 6/2861 | 374/161 |
| 5,051,590 | A * | 9/1991 | Kern | G08B 17/12 | 374/161 |
| 5,051,595 | A * | 9/1991 | Kern | G08B 17/12 | 374/161 |
| 5,064,271 | A * | 11/1991 | Kern | G08B 17/12 | 385/33 |
| 5,144,125 | A * | 9/1992 | Carter | G08B 17/02 | 250/227.15 |
| 2002/0050932 | A1* | 5/2002 | Rhoades | G08B 25/14 | 340/870.16 |
| 2010/0236464 | A1* | 9/2010 | Kitamura | B63B 43/06 | 340/603 |
| 2017/0068016 | A1* | 3/2017 | Donderici | G01L 1/24 | |
| 2022/0283022 | A1* | 9/2022 | Ooi | G01D 5/35361 | |
| 2022/0397449 | A1* | 12/2022 | Iwano | G01D 21/00 | |

* cited by examiner

*Primary Examiner* — Hoi C Lau
(74) *Attorney, Agent, or Firm* — James H. Kasischke; Michael P. Stanley

(57) ABSTRACT

A distributed temperature system with at least one optical fiber is provided. Each optical fiber runs horizontally and vertically within at least one compartment of a ship. Each optical fiber connects to a distributed temperature system unit or is multiplexed to a single temperature system unit. The system employs Optical Time Domain Reflectometry to support measurements of optical pulses in processing bins defined along the fiber. The spatial fidelity of the measurement capability is sufficient to localize a fire detection in individual shipboard compartments. The system can diagnosis conflagration events that produce fire and also flooding in the compartment.

8 Claims, 1 Drawing Sheet

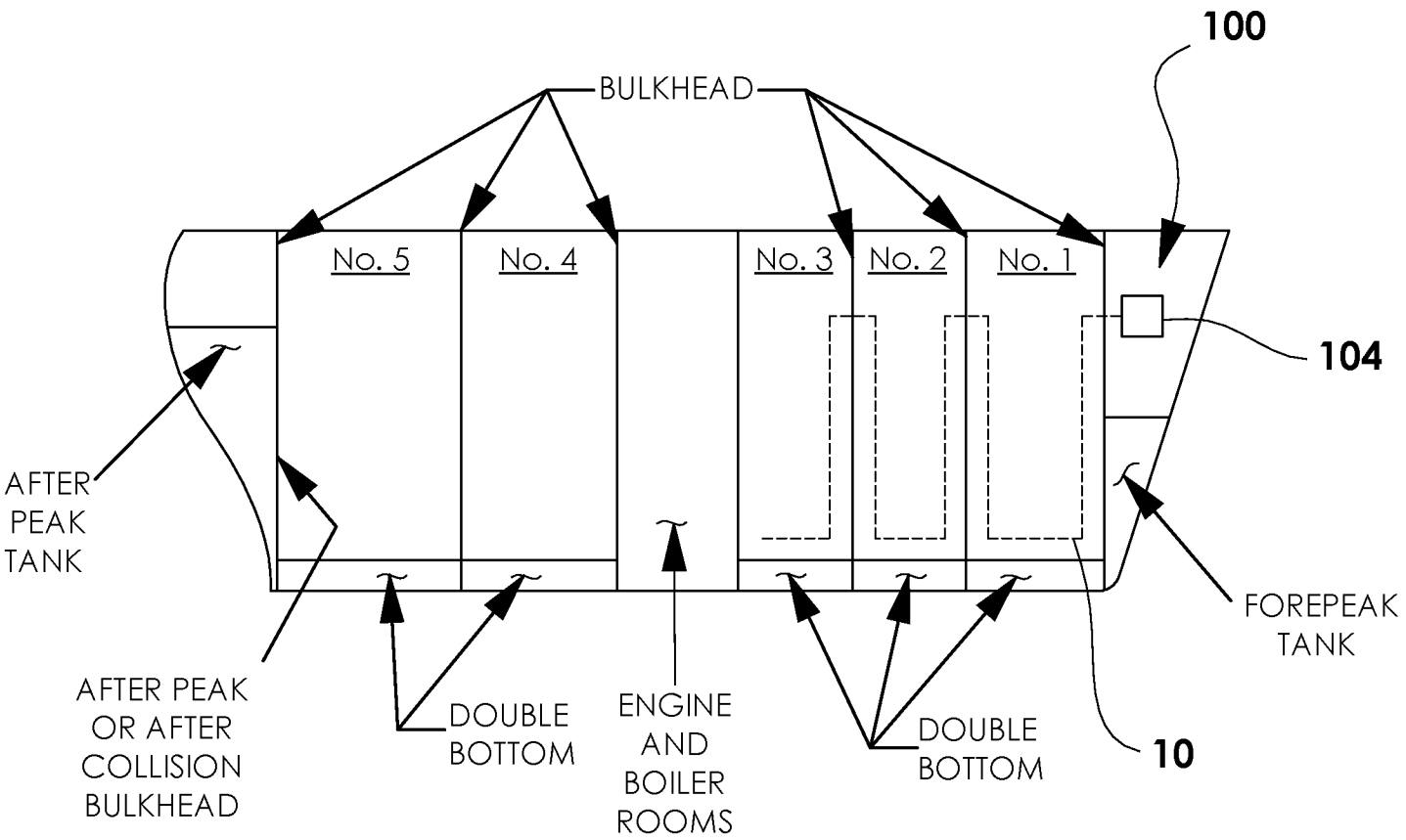
100
104
FOREPEAK TANK
10
No. 1
No. 2
No. 3
No. 4
No. 5
BULKHEAD
DOUBLE BOTTOM
ENGINE AND BOILER ROOMS
DOUBLE BOTTOM
AFTER PEAK OR AFTER COLLISION BULKHEAD
AFTER PEAK TANK

FIRE DETECTION AND CONFLAGRATION EVENT MONITORING AND DIAGNOSIS SYSTEM

The present application claims the benefit of U.S. Provisional Patent Application Ser. No. 63/229,144 filed on Aug. 4, 2021 with the invention entitled "Fire Detection and Conflagration Event Monitoring and Diagnosis System" by the inventors Anthony A. Ruffa and Charles M. Traweek.

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER APPLICATIONS

None.

BACKGROUND OF THE INVENTION

(1) Field of the Invention

The invention is a system that provides conflagration event damage control as well as firefighting monitoring, localization, and diagnosis.

(2) Description of the Related Art

Recent shipboard fires have highlighted the need for improved systems for shipboard damage control and firefighting. Firefighting on ships presents challenges in that some compartments are prone to flooding as a result of the water used to extinguish the fire.

Several elements of the prior art are capable of being used for this invention. For example: a fiber in a double stainless steel tube can survive 500 degrees Centigrade, while a gold-coated fiber in a stainless steel tube can survive 650 degrees Centigrade. As long as the fiber remains intact, the fiber can still make measurements.

Fiber-based distributed temperature measurement systems are capable of detecting air and water interfaces. The technology described in U.S. Pat. No. 8,047,709 and incorporated herein by reference; is able to detect an air/water interface because there is almost always a difference in temperature. Thus, each measurement bin has a high-temperature threshold for fire detection and an air/water detection system.

Based on the possible uses for optical fibers, improved and non-invasive fire and temperature monitoring systems are functional and still needed for shipboard use.

BRIEF SUMMARY OF THE INVENTION

The present invention provides a fiber-optic distributed temperature measurement system for detecting, localizing, monitoring, diagnosing, prioritizing, and objectively managing the Damage Control and Fire Fighting (DC/FF) response to fires that may be the cause or an element of a shipboard conflagration event.

The monitoring information corresponding to all locations along the network of fibers within the measurement system that span instrumented compartments can automatically initiate courses of action for DC/FF including the sounding of alarms and activation of sprinkler systems and/or other DC/FF systems to quickly control a fire or to isolate seawater systems.

The informational history of the distributed temperature measurements and of the spatial and temporal correlations between the measurements can identify the time and location of the initial abnormality. In combination with prior knowledge of air/oxygen storage storage and distribution systems, combustable fuels, pyrotechnics, and explosive ordnance, the inventive system identifies potential diagnoses for the causes and to identify the conditions that would be encountered by DC/FF for personnel upon entry of a compartment, risk to equipment, resources as well as personnel in adjacent compartments.

This same prior knowledge and the time history of the dynamics of the progression of fire and flooding can inform the DC/FF process of identifying courses of action appropriate to the circumstances, including operational priorities and circumstances.

The temperature measurement system of the present invention uses known fiber optic temperature measurement systems with standard single mode or multi-mode communications grade fiber. The measurement system is an adaptation of optical time domain reflectometry that supports measurements of optical pulses in processing bins which are nominally defined for each meter along the optical fiber.

The spatial fidelity of the measurement capability can localize a hot-spot to individual shipboard compartments as well as locations such as lube-oil and/or hydraulic fluid reservoirs, air and/or oxygen storage tanks, and pyrotechnic and/or ammunition storage. In the present system, the spatial fidelity is the precision of localization of the temperature signal where the temperature signal can be localized at approximately half meter bins along the fiber. The dynamic history of this hot-spot information is vital for successfully managing a response.

In the system, numerous optical fibers run throughout a ship connected to distributed temperature system units. The distributed temperature system units pinpoint the fire location or hot-spot and the extent of each. Since the temperatures associated with a fire normally exceed 1000 degrees Fahrenheit; a false alarm is unlikely.

The individual fibers are interrogated either by a single distributed temperature measurement system or by multiple distributed temperature measurement systems sequentially making measurements along each individual fiber. A display at the DTS unit, which may be observed in remote locations, correlates the monitoring results along the fibers to corresponding positions within compartments and relative to flammable/explosive material and/or compressed air concentrations within the compartment.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing and wherein FIG. 1 is a schematic of a single distributed temperature system with a fiber network supporting the conflagration event monitoring and diagnosis system of the present invention.

DETAILED DESCRIPTION OF THE INVENTION

A distributed temperature system 100 supporting a single-ended measurement is shown in FIG. 1. In the Figure, an optical fiber 102 of the distributed temperature system 100 is depicted as a dashed line in a cut-away view of a ship or vessel 200. The optical sensing fiber 102 is positioned to span a horizontal and vertical extent of the forward compartments (No. 1, No. 2 and No. 3); however, the sensing fiber can instrument a single compartment along multiple paths and similarly be used simultaneously in other compartments of the ship 200.

Between the forward compartments, the optical sensing fiber 102 runs through stuffing tubes in each compartment bulkhead in a manner known to those skilled in the art. The optical sensing fibers 102 can use fiber that exists in the ship for other uses, or can use new sensing fibers.

For some ships or vessels, it is possible to monitor the entire vessel with a single fiber. However, depending on the compartment layout, a single fiber may not be able to monitor every compartment such that numerous fibers will be needed. Each optical sensing fiber 102 can connect to a separate distributed temperature system (DTS) fiber interrogation unit 104 which measures the temperature within bins corresponding to successive lengths of the fiber by exploiting a known and well-understood temperature dependent Raman scattering effect.

Instead, the fibers can be multiplexed to a single unit corresponding to a convenient locations such as a so-called Damage Control Central location. A robust network or fibers and multiplexing design can support monitoring from multiple locations, a useful option in the case of a conflagration event that could render a Damage Control Central facility to become inoperable or uninhabitable.

In operation, the DTS unit 104 detects a temperature change along a fiber 102 within a compartment corresponding to a location within the affected compartment; informs a decision to classify the temperature change as one corresponding to a rising water level or to a heat source in the air; initiates the appropriate fire or flooding alarm; activates a fire suppression system/sprinkler system or engages sump pumps to evacuate the flooding water and, depending upon operational circumstances, actuates hull seawater isolation valves.

Diagnosis of conflagration events that simultaneously produce flooding and fire can benefit from optical sensing fibers that run vertically within compartments in which temperature measurements along the fiber can be correlated to expected normal values. Modest temperature variations along the fiber corresponding to the bottom of a compartment and rising can be indicative of flooding and more precisely for the depth of water in the compartment. Hot temperatures are indicative of fire within the compartment. Temperatures, their locations, and temperature differences within a compartment can provide information useful in identifying the fuel of source and/or location within a compartment.

This invention can also make use of existing optical fibers that are used in the ship for communication, instrumentation, and other purposes to provide protection with a minimum installation of new fibers. Optical pulses employed to support the Raman scattering measurements can be multiplexed with existing communications or telemetry signals. In addition, the identical capability can identify alternative or redundant data as well as information routing alternatives.

The invention uses currently-available fiber optic distributed temperature measurement systems with standard single mode or multi-mode communications grade fiber. The measurement system 100 employs an adaptation of Optical Time Domain Reflectometry (OTDR) to support measurements of optical pulses in processing bins nominally defined each meter along the fiber.

As an example, measurements made every two minutes have an accuracy of 0.1 degrees Centigrade. However, the measurement time can be shortened to 10 seconds or less. The error scales as the square root of the number of individual measurements included in each averaged measurement. The spatial fidelity of the measurement capability localizes a hot-spot to individual shipboard compartments as well as to locations such as lube-oil and/or hydraulic fluid reservoirs, air and/or oxygen storage tanks, and pyrotechnic and/or ammunition storage.

Temperature measurements are made by Raman scattering. Raman scattering is an inelastic scattering process involving an incident photon interacting with lattice vibration modes. Raman scattering leads to frequency shifts with approximately one in $10^6$ scattered photons. The incident photon can lose energy to a phonon. For example, the incident photon can be Stokes-shifted to a longer wavelength.

Shorter wavelength shifts can also occur and are attributed to the simultaneous annihilation of one photon of incident radiation and one thermally-excited phonon followed by the creation of a photon with higher energy (anti-Stokes). The temperature is deduced from the ratio of Stokes and anti-Stokes intensities.

In the installation of the invention, the optical fibers 102 run throughout the ship and connect to at least one distributed temperature system unit 104. In operation, the distributed temperature system 100 pinpoints the location, extent, and intensity [temperature] of a fire. Since the temperatures associated with a fire exceed 1000 degrees Fahrenheit, a false alarm is very unlikely.

As long as the fiber remains intact, the fiber is capable of making measurements. Objective knowledge of the distribution of fiber discontinuities, particularly in combination with surrounding compartment temperatures, can provide timely fire configuration management information. Similarly, the sequence in time and space of fiber discontinuities can be useful in classification of the cause of a fire and/or an explosion during a DC/FF conflagration.

In one embodiment, individual fibers are run throughout the ship and monitored either by a single distributed temperature system or by multiple distributed temperature system systems; thereby, sequentially making measurements in each individual fiber. A display correlates the monitoring results to corresponding compartments and in relation to flammable/explosive material concentrations within the compartments.

The optical fibers can sense a flooding event to enable a flooding alert as well as providing a damage control monitoring capability. In addition to fire and flooding alerts, a temperature display of the fire in the affected compartment indicates the severity of the fire. Elevated temperatures coupled with breached fibers indicates that the temperature at that location exceeds the survival temperature of the optical fiber. Knowledge of the temperature distribution and the dynamics of the changes within are important in identifying effective DC/FF courses of action.

A vertical sensing fiber can detect flooding in the affected compartment; shuts off the water supply to sprinkler systems in that compartment if flooding of the ship is deemed a greater threat than fire in the affected compartment; and/or engage high-powered sump pumps to evacuate the flooding water.

Inter-compartmental temporal and spatial correlation of intra-compartmental temperature information can assess the distribution of the intensity of fire and flooding effects, to assess the rate of expansion of a conflagration event, and to inform the DC/FF course of action. Multiplexing can allow one DTS to monitor multiple fiber paths and/or multiple DTS units to provide a networking monitoring capability that is robust during a conflagration event.

The level of flooding in each compartment can also support a real-time assessment of the stability of trim and reserve buoyancy available. Specifically, the water level measured in each compartment and the weight corresponding to that water level is provided to update an algorithm that monitors the ship weights and moments to assess the ship ballasting, buoyancy, stability, and survivability in choosing between fighting fires and combatting flooding during a conflagration event.

A fiber wound around a vertical mandrel can enhance the spatial fidelity of the temperature measurement to reduce the vertical spatial uncertainty of the water level. The temperature is measured in half-meter bins along the fiber. A fiber wound around a vertical mandrel can reduce the vertical spatial uncertainty by more than an order of magnitude, depending on the mandrel diameter and the helix angle.

Fiber-based pressure measurements can enhance the DC/FF capability. This is done via Rayleigh-scattered measurements along the fiber. This would require a second unit in addition to the DTS unit. The second unit also comprises a laser source and receiver and processor, but the second unit measures and interpret the Rayleigh scattered returns to infer the strain, and by extension, the pressure. Both the DTS unit and the second unit can interrogate the same fibers via multiplexing.

Current technology supports strain measurements via Rayleigh-scattered measurements in a standard single mode or multimode telecommunications grade fiber. Employing an adaptation of Optical Time Domain Reflectometry (OTDR) supports time-of-flight measurements of backscattered light that are collected in processing bins defined every half-meter along the cable.

Specifically, a fiber wound around a mandrel can enhance the pressure sensitivity of a fiber to create a compartment pressure sensor that would be useful in making decisions to open compartment doors and/or hatches. Measuring compartment air pressure could also be supported to identify compartments that are exposed to sea pressure and/or are vented to one another. Furthermore, emergency communication could also be supported by which a person trapped in a compartment in which the person can signal by tapping on a portion of, or in the vicinity of, a fiber using a code, or a method of one-way voice communication from an instrumented compartment The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A distributed temperature sensing system for shipboard use, said system comprising:

at least one distributed temperature measurement unit; and at least one optical sensing fiber operationally connected to said at least one distributed temperature measurement unit, said at least one optical sensing fiber capable of spanning a horizontal and vertical extent of at least one compartment of a ship;

an optical temperature interrogation unit with a display operationally connected to said at least one distributed temperature measurement unit wherein said display is capable of correlating monitoring of said at least one distributed temperature measurement unit to corresponding compartments and to the locations within those compartments adjacent to positions along the path of said at least one fiber;

wherein said distributed temperature system is capable of fire detection and detecting flooding water in the at least one compartment.

2. The distributed temperature sensing system in accordance with claim 1, wherein said distributed temperature system is capable of shutting off a water supply to sprinkler systems in the at least one compartment.

3. The distributed temperature sensing system in accordance with claim 2, wherein said distributed temperature system is capable of engaging high-powered sump pumps to route the flooding water back to the sprinkler systems.

4. The distributed temperature sensing system in accordance with claim 3, wherein said distributed temperature sensing system employs Optical Time Domain Reflectometry to support measurements of optical pulses in processing bins defined nominally each meter along said at least one optical sensing fiber.

5. A method for fire detection and event monitoring aboard a ship, said method comprising the steps of:

providing at least one distributed temperature measurement unit;

providing at least one optical sensing fiber operationally connected to the at least one distributed temperature measurement unit;

detecting a fire with the at least one optical sensing fiber;

measuring temperatures by Raman scattering for fire detection;

monitoring the fire detection with the distributed temperature measurement unit to individual compartments of the ship;

monitoring flooding by Raman scattering in the individual compartments of the ship; and displaying correlated results of the monitoring of the fire detection and the monitoring of flooding to corresponding compartments and correlation of locations along the at least one optical sensing fiber to equipment, components, and materials.

6. The method in accordance with claim 5, said method further the steps of:

providing an activation signal for shutting off a water supply to sprinkler systems in flooded compartments; and providing a signal to activate sump pumps to remove water from the flooded compartments.

7. The method in accordance with claim 5, wherein measurements are taken every two minutes.

8. The method in accordance with claim 5, wherein measurements are taken in less than ten seconds.

* * * * *